US006161391A

United States Patent [19]

Trieskey

[11] Patent Number: 6,161,391

[45] Date of Patent: Dec. 19, 2000

[54] ENVIRONMENTAL TEST CHAMBER FAST COOL DOWN SYSTEM AND METHOD THEREFOR

[76] Inventor: Guy T. Trieskey, 1213 E. Gemini, Tempe, Ariz. 85283

[21] Appl. No.: 09/387,315

[22] Filed: Aug. 31, 1999

[51] Int. Cl.[7] ..... F25B 7/00

[52] U.S. Cl. ..... 62/79; 62/335

[58] Field of Search ..... 62/79, 175, 335

[56] References Cited

U.S. PATENT DOCUMENTS 4,000,626 1/1977 Webber .
4,149,389 4/1979 Hayes et al. .
4,637,219 1/1987 Grose .
5,105,633 4/1992 Briggs .
5,323,618 6/1994 Yoshida et al. .
5,386,709 2/1995 Aaron .
5,687,579 11/1997 Vaynberg .

*Primary Examiner*—William E. Tapolcai
*Attorney, Agent, or Firm*—Jeffrey Weiss; Jeffrey D. Moy; Weiss & Moy, P.C.

[57] ABSTRACT

An environmental test chamber fast cool down system. The environmental test chamber fast cool down system, comprises: an environmental test chamber evaporator, a cascade condenser coupled to the environmental test chamber evaporator, a sub-cooled primary stage loop coupled to the cascade condenser, a sub-cooled secondary stage loop coupled to the cascade condenser, and a thermal storage unit coupled to the sub-cooled primary stage loop and to the sub-cooled secondary stage loop.

23 Claims, 7 Drawing Sheets

CASCADE SYSTEM WITH THERMAL STORAGE

THE REFRIGERATION CYCLE

A TO B EVAPORATOR PRESSURE CONSTANT ENTHALPY INCREASES.

B TO C COMPRESSOR BOTH PRESSURE AND ENTHALPY INCREASE.

C TO D CONDENSER PRESSURE CONSTANT ENTHALPY DECREASES.

D TO A METERING DEVICE PRESSURE DECREASES ENTHALPY CONSTANT.

CONVENTIONAL CASCADE SYSTEM

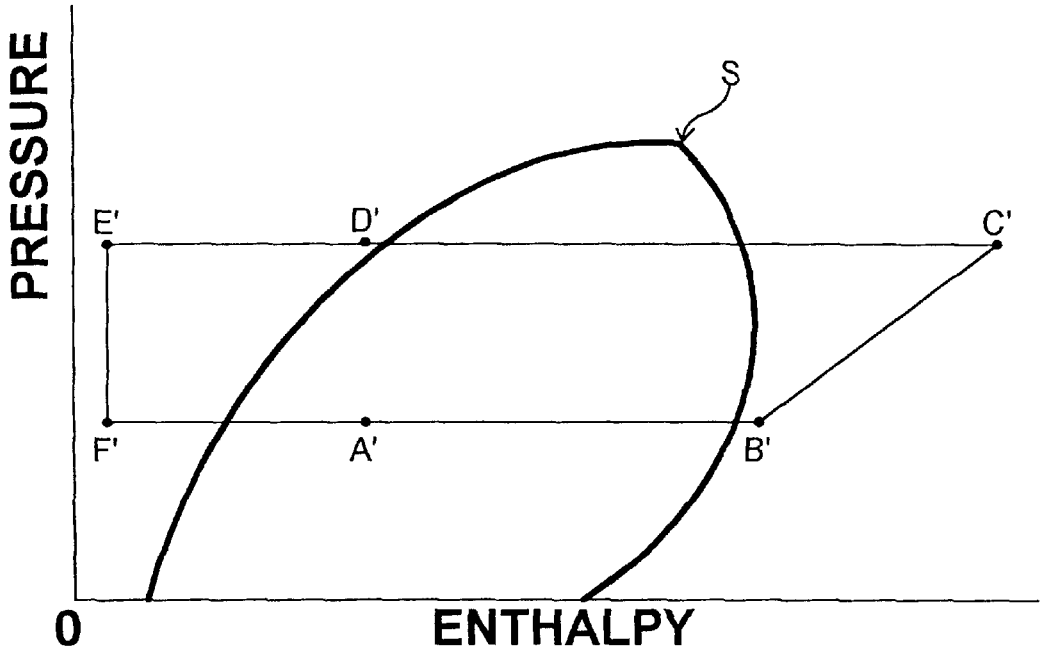

THE REFRIGERATION CYCLE NOW SUBCOOLED
BY THE THERMAL STORAGE SYSTEM

POINT A' NO LONGER HAS ANY SIGNIFICANCE

F' TO B' EVAPORATOR
PRESSURE CONSTANT ENTHALPY INCREASES.

B' TO C' COMPRESSOR
BOTH PRESSURE AND ENTHALPY INCREASE.

C' TO D' CONDENSER
PRESSURE CONSTANT ENTHALPY DECREASES.

D' TO F' THERMAL STORAGE SYSTEM (SUBCOOLING)
PRESSURE CONSTANT ENTHALPY DECREASES.

E' TO F' METERING DEVICE
PRESSURE DECREASES ENTHALPY CONSTANT.

FIGURE 3

CASCADE SYSTEM WITH THERMAL STORAGE

| COOLING DEMAND FROM TEMPERATURE CONTROLLER | FULL COOLING 100% OUTPUT | PARTIAL COOLING 0-100% OUTPUT | NO COOLING 0% OUTPUT |
|---|---|---|---|
| COOL SOLENOID VALVE<br>368 468 | OPEN | PROPORTIONED 0-100% OUTPUT | CLOSED |
| BYPASS SOLENOID VALVE<br>338 438 | CLOSED | OPEN | OPEN |
| FULL COOL SOLENOID VALVE<br>354 454 | OPEN | CLOSED | CLOSED |
| BYPASS SOLENOID VALVE<br>352 452 | CLOSED | OPEN | OPEN |
| REMARKS | MAXIMUM COOLING OF LOAD | TEMPERATURE OF LOAD MAINTAINED THERMAL STORAGE UNIT RECHARGED | THERMAL STORAGE UNIT RECHARGED |

TABLE 1

FIGURE 7

ENVIRONMENTAL TEST CHAMBER FAST COOL DOWN SYSTEM AND METHOD THEREFOR

BACKGROUND OF THE INVENTION

1. Field of the Invention

This invention relates to environmental test chamber heating and cooling systems, and more specifically, to an improved method of cooling environmental test chambers using an lower capacity, smaller footprint cascade refrigeration unit in combination with a thermal storage unit.

2. Description of the Related Art

Environmental test chambers subject components within them to a variety of physically challenging test conditions. These test conditions can include acceleration tests, sand or water tests, and temperature tests. The temperature tests can consist of not extremes of heat and cold, but also tests of large temperature change in very short periods of time. A typical environmental test chamber system for imposing large temperature changes in very short periods of time comprises either a single or twin section insulated environmental test chamber, and coupled to the environmental test chamber, a large capacity refrigeration system. A large capacity environmental test chamber system is capable of imposing a temperature change from +150° C. to −65° C. in the span of five minutes, and reducing the temperature to −73° C. Additionally, slower tests utilizing temperature ramp rates of five, ten, or 20° C. per minute are also within this field, still have large system capacity requirements.

A more complete explanation of environmental test methods and standards is detailed in: the Electronics Industries Association's, (EIA) JEDEC JESD22 group of specifications; Military Specifications Mil-Std 202, Mil-Std 750, Mil-Std 810, and Mil-Std 883; and the IEC pub 68 IEC Standards, all of which are incorporated herein by reference.

The physical plant requirements to produce these temperature changes, whether the very fast temperature ramp rate or the slower ramp rates, are very substantial. A large tonnage refrigeration system is required, and the physical size of such a large capacity refrigeration system is correspondingly large. A large tonnage refrigeration system also has substantial energy requirements while it is in operation. An additional problem with conventional environmental test chamber systems is that the temperature transient, from the hot extreme to the cold extreme, for cyclic testing may be quite large. In order to subject the item under test to the desired temperature transition, the item under test in an environmental test chamber system must either: (1) be physically moved from a first pre-heated hot chamber into a second pre-cooled cold chamber, a physical transition that requires two separate and insulated chambers which results in a system with a double size facilities footprint; or (2) for a single chamber environmental test chamber system, this refrigeration system must be larger yet to enable the sudden heat transfer of the item under test's heat load.

Therefore, a need existed for an improved environmental test chamber refrigeration system that has the requisite temperature transition capabilities utilizing a smaller capacity cascade refrigeration system for single chamber environmental test chambers. Another need existed for an improved environmental test chamber refrigeration system that has the requisite temperature transition capabilities utilizing a smaller capacity cascade refrigeration system for dual chamber environmental test chambers. A further need existed for an improved environmental test chamber refrigeration system having only one insulated environmental chamber thereby eliminating the physical movement of an item under transition temperature testing and also providing a reduced facilities footprint. Yet a further need existed for an improved environmental test chamber refrigeration system having an improvement in energy usage efficiency.

SUMMARY OF THE INVENTION

It is an object of the present invention to provide an improved environmental test chamber refrigeration system that has the requisite temperature transition capabilities while utilizing a smaller capacity cascade refrigeration system for single chamber environmental test chambers.

It is another object of the present invention to provide an improved environmental test chamber refrigeration system that has the requisite temperature transition capabilities while utilizing a smaller capacity cascade refrigeration system for dual chamber environmental test chambers.

It is a further object of the present invention to provide an improved environmental test chamber refrigeration system having only one insulated environmental chamber thereby eliminating the physical movement of an item under transition temperature testing and also providing a reduced facilities footprint.

It is yet a further object of the invention to provide an improved environmental test chamber refrigeration system having an improvement in energy usage efficiency.

The foregoing and other objects, features, and advantages of the invention will be apparent from the following, more particular, description of the preferred embodiment of the invention, as illustrated in the accompanying drawings.

BRIEF DESCRIPTION OF THE PREFERRED EMBODIMENTS

According to one aspect of the invention, an environmental test chamber fast cool down system is disclosed. The environmental test chamber fast cool down system comprises: an environmental test chamber evaporator, a cascade condenser coupled to the environmental test chamber evaporator, a sub-cooled primary stage loop coupled to the cascade condenser, a sub-cooled secondary stage loop coupled to the cascade condenser, and a thermal storage unit coupled to the sub-cooled primary stage loop and to the sub-cooled secondary stage loop.

According to another aspect of the invention, an environmental test chamber cooling system is disclosed. The environmental test chamber cooling system comprises: an environmental test chamber evaporator, a thermal storage unit coupled to the environmental test chamber evaporator having an operational temperature down to about −125° F., a high stage refrigeration loop coupled to the thermal storage unit wherein the high stage refrigeration loop has an enthalpy change of about 104 BTUs per pound of refrigerant circulated, and a low stage refrigeration loop coupled to the thermal storage unit wherein the low stage refrigeration loop has an enthalpy change of about 68 BTUs per pound of refrigerant circulated.

According to yet another aspect of the invention, a method of fast cooling an environmental test chamber is disclosed. The method of fast cooling an environmental test chamber comprises the steps of: pre-cooling a thermal storage unit to about minus 125° F., cooling a first refrigerant to an enthalpy of about 50.6, circulating the first refrigerant through the thermal storage unit to an enthalpy of about −17.2, circulating the first refrigerant through a cascade condenser, circulating a second refrigerant through the cascade condenser to an enthalpy of about 14.6, circulating the second refrigerant through the thermal storage unit to an enthalpy of about −16.4, circulating the second refrigerant through an environmental test chamber evaporator cooling coil.

BRIEF DESCRIPTION OF THE DRAWINGS

FIG. 3 is a pressure—enthalpy curve and sub-cooled refrigeration cycle applicable to the present invention.

FIG. 7 is a table of operation showing the various elements of the refrigeration system in different stages of operation.

DESCRIPTION OF THE PREFERRED EMBODIMENTS

It should be noted in the following discussion that many items well known to those skilled in the relevant art have been left out of the conceptual drawings and conceptual explanations regarding the prior art and the present invention. These items include, without being limited to items such as: sight glasses, filter dryers, receiver tanks, etc. Those skilled in the relevant art will therefore appreciate that these items are in fact present.

DISCUSSION OF THE PRIOR ART

Figure 1:
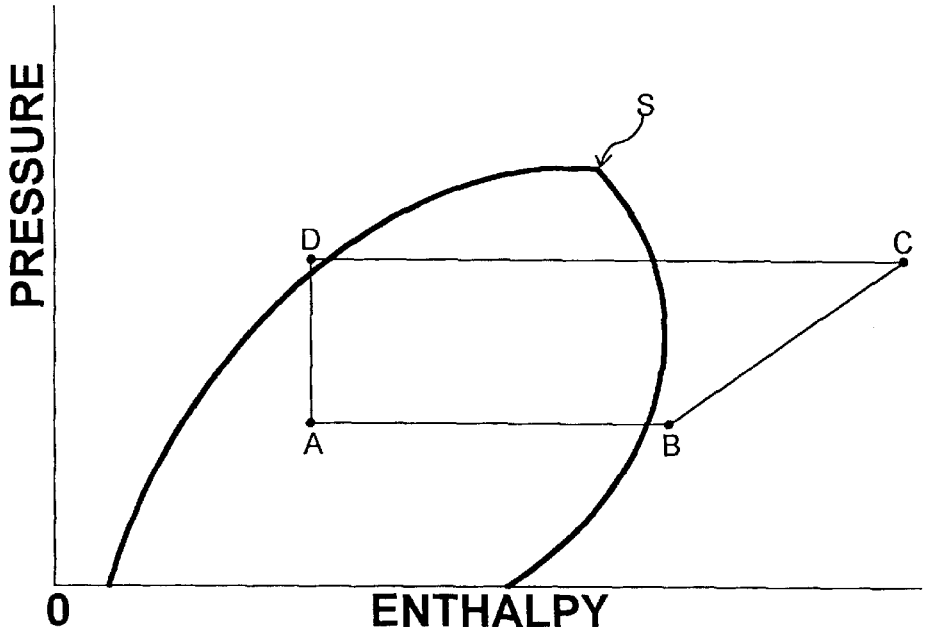
FIG. 1 is a pressure—enthalpy curve and refrigeration cycle applicable to the prior art.

Referring to FIG. 1, a saturation curve "S" and refrigeration cycle for a refrigerant applicable to the prior art is shown. The area bounded by the points A, B, C and D represents the refrigeration cycle of an ideal, prior art, refrigeration cycle. Each of the points A, B, C and D represent a point of particular pressure and temperature for a refrigerant. The actual point temperatures and pressures depend on many factors including the type of refrigerant, the component efficiencies etc. Those skilled in the art will recognize that these factors will result in an actual, or typical refrigeration cycle, that is not as symmetrical as is this ideal example.

This ideal refrigeration cycle has the following segments:

1. Point A to B: The refrigerant passing through the evaporator absorbs heat at an essentially constant pressure thus resulting in an increase in the enthalpy of the refrigerant. During this period the refrigerant is in the saturated region for the substantial portion of this period.
2. Point B to C: The system compressor works on the refrigerant increasing its pressure. Pressure, temperature, and thus enthalpy all increase during this period. During this period the refrigerant is in the superheated vapor region.
3. Point C to D: During this period, the refrigerant passes through the condenser that removes the heat: resulting from the working process. Thus, pressure is essentially constant while the enthalpy drops significantly leaving the superheat condition and entering the saturated region again. It should be noted here that while point D is barely into the sub-cooled region on this Figure, low stage conventional systems typically have point D within the saturated region, and do not even have any sub-cooling effect.
4. Point D to A: As the refrigerant passes through an expansion valve and into the evaporator the pressure drop causes the phase change of the refrigerant from sub-cooled to a saturated liquid, thus bringing the refrigeration cycle out of the sub-cooled region almost immediately. The PSat-TSat relationship results in a substantial temperature drop of the refrigerant. During this period the phase change also contributes to the temperature drop. It should be noted that the enthalpy is essentially constant during this period of pressure reduction. The phase change is an important part of conventional refrigeration systems.

This refrigeration cycle applies to both single loop conventional refrigeration systems and also to each refrigerant in a cascade refrigeration system.

Figure 2:
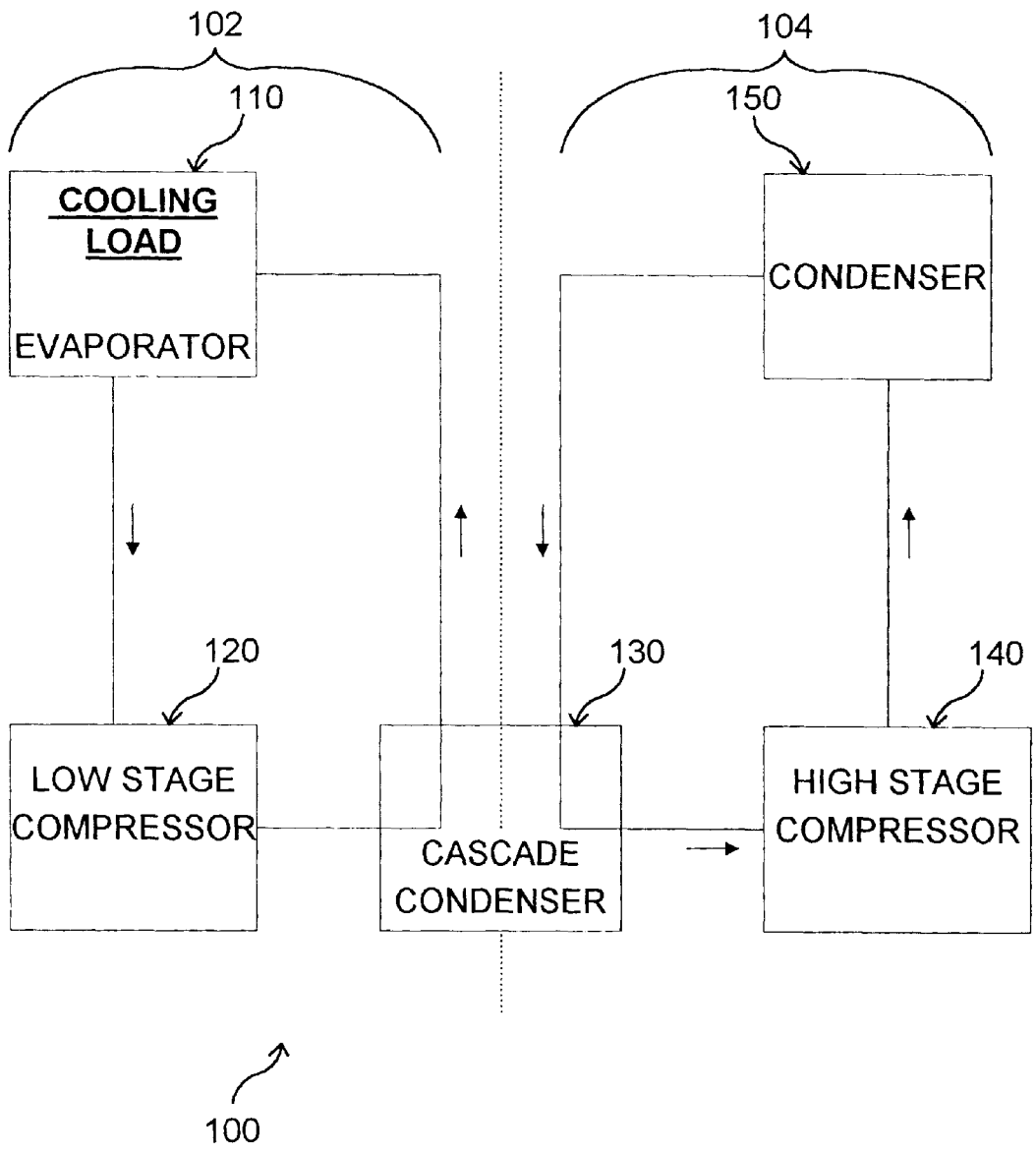
FIG. 2 is a conceptual block diagram of a prior art environmental test chamber cascade refrigeration system.

Referring to FIG. 2, a conceptual block diagram of a prior art environmental test chamber cascade refrigeration system 100 ("prior art system 100" hereinafter) is shown. The heat content of the refrigerant at various stages in the system will be discussed in the following. The heat content is known as enthalpy and is generally denoted by the symbol "H". Enthalpy is a state function whose change equals the heat absorbed by a system at constant pressure. Enthalpy is defined as: $H=U+PV$; where U is the internal energy, P is the pressure of the system and V is the volume of the system. The reference state where $H=0$, is defined for pure elements at 25° C. (77° F.) and one atmosphere of pressure. The enthalpy value of a refrigerant, not a pure element, is described in British Thermal Units (BTU's) per pound circulated. And, the nominal $H=0$ is at a temperature of −40° C. (−40° F.). As this is an arbitrarily defined point, enthalpy values may be less than zero for appropriate conditions of pressure and temperature.

The prior art cascade system shown in FIG. 2 is explained with the following initial conditions:

Both low and high stage compressors 120 and 140 are operating. It should be noted that while not shown herein, other required equipment such as fans, control equipment etc. is also functional.

The cooling load 110 is warmer than the desired temperature. Note that a single section environmental test chamber is the cooling load 110 herein, although the use of a dual section environmental test chamber would also be applicable herein.

The low-stage system 102 contains refrigerant R508B.

The high-stage system 104 contains refrigerant R507.

Those skilled in the art will recognize that even though this explanation discusses certain refrigerants, other refrigerants are very similar in their response and are generically speaking well within this explanation. Furthermore, the exact values of a particular prior art system will vary with the specific system design and the starting and ending temperatures of the cooling load, etc. For example, each of the compressors in a cascade system, though typically of the same type in each high and low stage system, do not possess exactly the same refrigerant flow rate.

Referring again to FIG. 2, liquid R508B refrigerant enters the cooling load evaporator 110 with an enthalpy of approximately 14.6 BTU's per pound circulated. At this enthalpy the R508B refrigerant vaporizes at approximately −82° F. which increases it's enthalpy to 52.0 BTU's per pound circulated. Therefore, the net work done by the low stage compressor 120 is the difference between the pre-cooling load 110 enthalpy and the pre-low stage compressor 120 enthalpy, which equals 37.4 BTU's per pound circulated.

The heat absorbed by the low-stage system 102 R508B refrigerant is delivered to the high-stage system 104 R507 refrigerant via the cascade condenser heat exchanger 130. The R507 refrigerant enters the cascade condenser heat exchanger 130 with an enthalpy of approximately 50.6 BTU's per pound circulated. The R507 refrigerant is vaporized by the heat from the R508B refrigerant resulting in an enthalpy increase to approximately 87.2 BTU's per pound circulated. Therefore, the net work done by the high stage compressor 140 is the difference between the pre-cascade condenser heat exchanger 130 enthalpy and the pre-high stage compressor 140 enthalpy, which equals approximately 36.6 BTU's per pound circulated. The cooling load 110 thus has it's heat gradually removed until it is cooled down to the desired temperature. During this process the operating conditions of the prior art system 100 change to colder values as the cooling load 110 heat is removed from the prior art system 100 via the condenser 150.

Referring again to FIG. 2, at a desired endpoint temperature of the cooling load 110 of approximately −100° F., liquid R508B refrigerant enters the cooling load evaporator 110 with an enthalpy of approximately 11.5 BTU's per pound circulated. R508B refrigerant vaporizes at approximately −100° F. and it's enthalpy increases to approximately 50.3 BTU's per pound circulated. Therefore, the net work done by the low stage compressor 120 is the difference between the pre-cooling load 110 enthalpy and the pre-low stage compressor 120 enthalpy, which equals approximately 38.8 BTU's per pound circulated.

The heat absorbed by the low-stage system 102 R508B refrigerant is delivered to the high-stage system 104 R507 refrigerant via the cascade condenser heat exchanger 130. The R507 refrigerant enters the cascade condenser heat exchanger 130 with an enthalpy of approximately 50.6 BTU's per pound. circulated. The R507 refrigerant is vaporized by the heat from the R508B refrigerant resulting in an enthalpy increase to approximately 85.9 BTU's per pound circulated. Therefore, the net work done by the high stage compressor 140 is the difference between the pre-cascade condenser heat exchanger 130 enthalpy and the pre-high stage compressor 140 enthalpy, which equals approximately 35.3 BTU's per pound circulated. In general the foregoing is applicable to all prior art environmental cooling systems.

DISCUSSION OF THE PRESENT INVENTION THEORY AND EMBODIMENTS

Note that in the following discussion, like numbering of items and curves of FIGS. 3–6 is employed for similar items and explanations as exist in FIGS. 1–2, in accordance with the following provisos. In the case of FIG. 3, the points on the refrigeration cycle have had a prime mark, e.g. A' vs. A, added to them. And in the case of FIGS. 4, 5, and 6, the numbers are series 200, 400, and 300 respectively, e.g. 210 vs. 110.

Referring to FIG. 3, a saturation curve "S" and refrigeration cycle for a refrigerant applicable to the present invention is shown. The area bounded by the Points A', B', C', D', E' and F' represents the refrigeration cycle of an ideal present invention refrigeration cycle. Each of the points A', B', C', D', E' and F' represent a point of particular pressure and temperature for a refrigerant as used in the present invention. The actual point temperatures and pressures depend on many factors including the type of refrigerant, the component efficiencies etc. Those skilled in the art will recognize that these factors will result in an actual, or present invention, refrigeration cycle that is not as symmetrical as this ideal present invention example.

Figure 4:
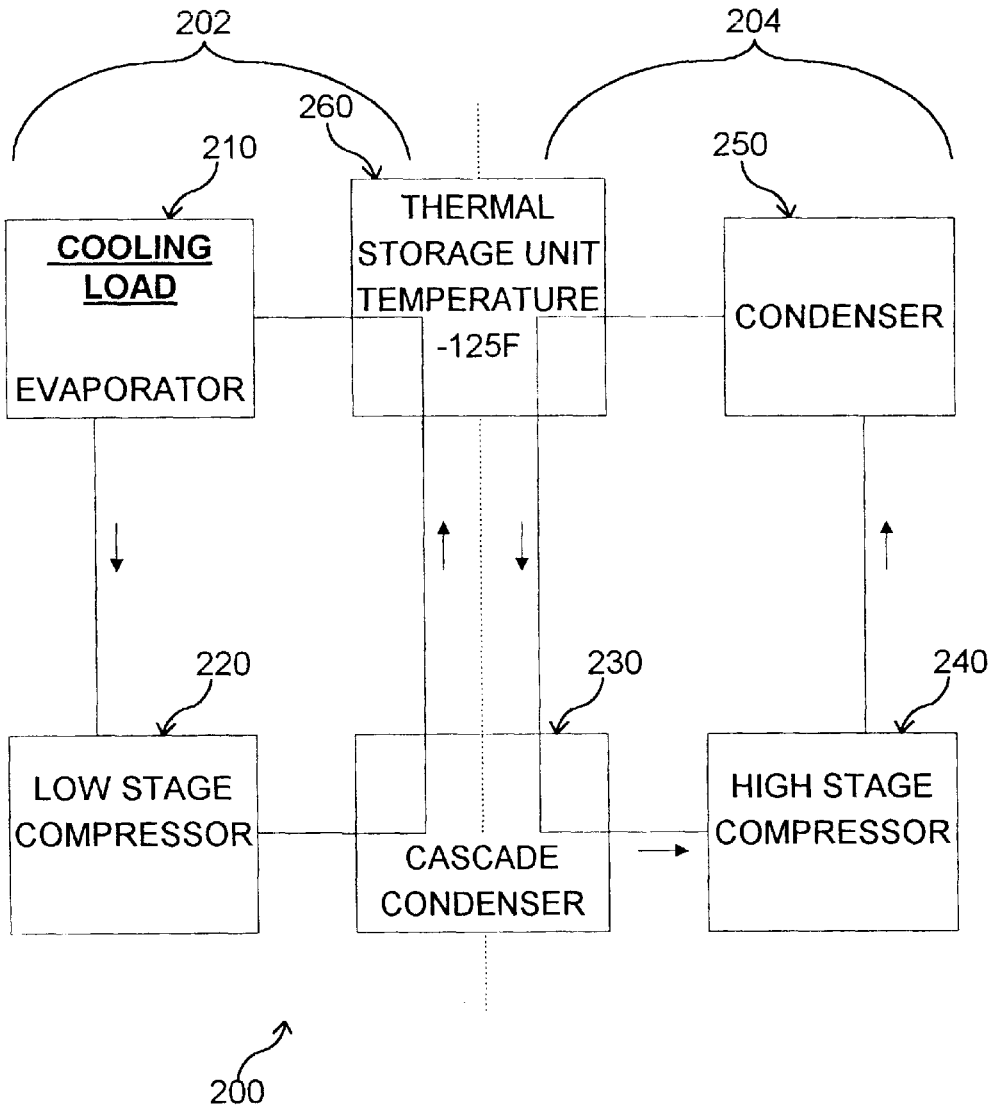
FIG. 4 is a conceptual block diagram of an environmental test chamber cascade refrigeration system of the present invention.

An ideal refrigeration cycle for the present invention has the following segments:

1. Point B' to C': The system compressor works on the refrigerant increasing its pressure. Pressure, temperature and thus enthalpy all increase during this period. During this period the refrigerant is in the superheated region.
2. Point C' to D': During this period, the refrigerant passes through the condenser which removes the heat that resulted from the working process. Thus, pressure is essentially constant while the enthalpy drops significantly leaving the superheat condition and entering the saturated condition again. It should be noted here that point D is barely into the sub-cooled region. As stated previously, this is an important point in conventional refrigeration systems.
3. Point D' to E': This segment represents an important feature of the present invention. Reference to FIG. 4 will show the addition of a thermal storage unit 260 to what would otherwise be a conventional cascade system. For now, it is sufficient to state that a thermal storage unit pre-chilled to about −100° F. to about −125° F. will cause a significant drop in the enthalpy of a refrigerant passing through it as is depicted on FIG. 3 from Point D' to Point E' This additional drop in the enthalpy of the refrigerant will result in a larger amount of work done per pound of refrigerant cycled through the system.
4. Point E to F: As the refrigerant passes through a metering valve and into the evaporator the pressure drop causes a temperature reduction due to the PSat-TSat relationship, though the enthalpy remains constant. Note that the refrigerant remains in liquid form. This is an important feature of the present invention, the shifting of part of the refrigeration cycle completely into the sub-cooled region at a lower enthalpy.
5. Point F' to B': The refrigerant passing through the evaporator absorbs heat at an essentially constant pressure thus resulting in an increase in the enthalpy of the refrigerant. The refrigerant enthalpy starts well into the sub-cooled region and as heat is absorbed enters the saturated region and ends just into the superheat region. During this period a large change in enthalpy occurs.

An object of the present invention is to enable a small capacity cascade refrigeration system, coupled to and cooling an environmental test chamber, of either the single or dual chamber variety, to achieve temperature rates of change that would otherwise require a much larger capacity refrigeration system. The present invention achieves this by utilizing the aforementioned thermal storage unit 260 (FIG. 4) that is typically pre-chilled to approximately −125° F.

The stored heat in the thermal storage unit allows not only the large temperature and enthalpy change already described, but also allows for the refrigeration system to be much smaller than otherwise required to achieve these temperature rates of change.

An additional feature of the thermal storage unit is that after a temperature transition has been achieved, the present invention's refrigeration systems can work on removing the stored heat energy that has been transferred into the thermal storage unit. Thus, after the environmental test chamber has achieved the required temperature, rather than running the refrigeration system at other than optimum efficiency, the excess capacity beyond what is required to maintain the temperature of environmental test chamber is now utilized to remove the stored heat in the thermal storage unit.

The end result of the present invention is the ability to achieve required transition rate of change of temperature with smaller refrigeration equipment which makes the overall footprint of the equipment smaller, and also allows for smaller utility services which may also save energy depending on the customer's usage.

Referring to FIG. 4, a conceptual block diagram of an environmental test chamber cascade refrigeration system ("system 100" hereinafter) of the present invention is shown. The heat content of the refrigerant at various stages in the system will be discussed in the following section. These are typical values obtained in an exemplary system. As those skilled in the art will recognize, actual values will vary from application to application depending on the specific equipment, refrigeration and application. The initial conditions are as follows.

Both low and high stage compressors 220 and 240 are operating. It should be noted that while not shown herein, other required equipment such as fans, control equipment etc. is also functional.

The cooling load 210 is warmer than the desired temperature. Note that a single section environmental test chamber is the cooling load 210 herein.

The low-stage system 202 contains refrigerant R508B.

The high-stage system 104 contains refrigerant R507.

Those skilled in the art will recognize that even though this explanation discusses certain refrigerants, other refrigerants are very similar in their response and are generically speaking, well within this explanation. Furthermore, the exact values of a particular embodiment of the present invention will vary with the specific system design and the starting and ending temperatures of the cooling load etc.

Referring again to FIG. 4, liquid R508B refrigerant enters the cooling load evaporator 210. However, in the present invention, the presence of a pre-cooled thermal storage unit 260 produces an enthalpy that is much lower than the prior art system. The liquid R508B refrigerant enters the thermal storage unit 260 with an enthalpy of 14.6 BTU's per pound circulated and the stored heat in the thermal storage unit 260 cools the refrigerant R508B to an enthalpy of −16.4 BTU's per pound circulated. At a high heat load situation the refrigerant R508B would be at less than a 100% liquid state and the final phase change to a 100% liquid that is sub-cooled would take place in the thermal storage unit 260. The refrigerant R508B passing through the thermal storage unit 260 is sub-cooled to an enthalpy of approximately −16.4 BTU's per pound circulated. Note that this is 31 BTU's per pound circulated more than the same point in the prior art system 100.

The −16.4 BTU's per pound circulated R508B refrigerant passes through the cooling load 210. The R508B refrigerant vaporizes at approximately −82° F., and the heat that is absorbed increases the enthalpy of the R508B refrigerant to approximately 52.0 BTU's per pound circulated.

Therefore, the net work done by the low stage compressor 220 in combination with the thermal storage unit 260 is the difference between the pre-cooling load 210 enthalpy and the pre-low stage compressor 220 enthalpy, which equals 68.4 BTU's per pound circulated, almost twice that of the prior art system.

The heat absorbed by the low-stage system 202 R508B refrigerant is delivered to the high-stage system 204 R507 refrigerant via the cascade condenser heat exchanger 230. The R507 refrigerant in the present invention passes through the thermal storage unit 260 after leaving the condenser 250. The R507 refrigerant enters the thermal storage unit with an enthalpy of 50.6 of BTU's per pound circulated where it is cooled to an enthalpy of −17.2 BTU's per pound circulated. The R507 refrigerant next enters the cascade condenser heat exchanger 230. The R507 refrigerant is vaporized by the heat from the R508B refrigerant resulting in an enthalpy increase to approximately 87.2 BTU's per pound circulated. Therefore, the net work done by the high stage compressor 240 is the difference between the pre-thermal storage unit 260 enthalpy and the pre-high stage compressor 240 enthalpy, which equals approximately 104.4 BTU's per pound circulated. This high BTU content per pound of R507 refrigerant circulated is almost three times greater than the prior art system 104 BTU content per pound circulated.

The cooling load 210 thus has it's heat removed until it is cooled down to the desired temperature. During this process the operating conditions of the prior art system 200 change to colder values as the cooling load 210 heat is removed from the prior art system 200 via the condenser 250, and the stored heat of the thermal storage unit 260. It can be seen that the work capacity of the system 200 has been increased such that smaller system components than utilized in the prior art will enable substantially the same temperature rate of change.

Referring again to FIG. 4, at a desired endpoint temperature of the cooling load 210 of approximately −100° F., the thermal storage unit has warmed up to approximately −50° F. The liquid R508B refrigerant enters the thermal storage unit 260 with an enthalpy of approximately 11.5 BTU's per pound circulated where it is cooled to an enthalpy of approximately 0.0 BTU's per pound circulated. The liquid R508B refrigerant next enters the cooling load evaporator 210. R508B refrigerant vaporizes at approximately −100° F. and it's enthalpy increases to approximately 50.3 BTU's per pound circulated. Therefore, the net work done by the low stage compressor 220 is the difference between the pre-thermal storage unit 260 enthalpy and the pre-low stage compressor 220 enthalpy, which equals approximately 50.3 BTU's per pound circulated.

The heat absorbed by the low-stage system 202 R508B refrigerant is delivered to the high-stage system 204 R507 refrigerant via the cascade condenser heat exchanger 230. The R507 refrigerant enters the thermal storage unit 260 with an enthalpy of approximately 50.6 of BTU's per pound circulated and is cooled to an enthalpy of approximately 0.0 BTU's per pound circulated. The R507 refrigerant next enters the cascade condenser heat exchanger 230. The R507 refrigerant is vaporized by the heat from the R508B refrigerant resulting in an enthalpy increase of the R507 refrigerant to approximately 85.9 BTU's per pound circulated. Therefore, the net work done by the high stage compressor 240 is the difference between the pre-thermal storage unit 260 enthalpy and the pre-high stage compressor 240 enthalpy, which equals approximately 85.9 BTU's per pound circulated.

Preferred Embodiment

Figure 5:
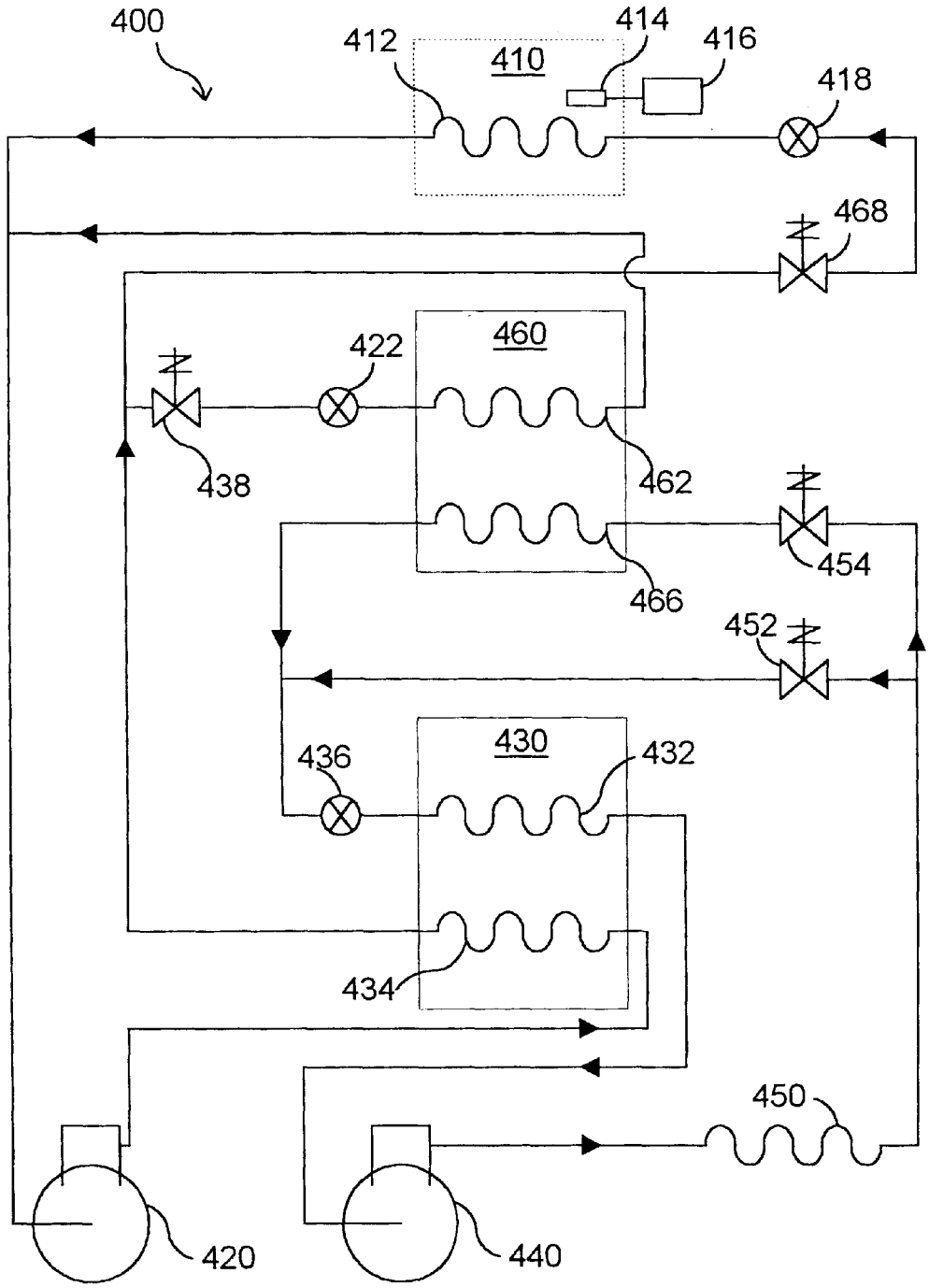
FIG. 5 is a functional block diagram of a preferred embodiment environmental test chamber cascade refrigeration system of the present invention.

Referring to FIG. 5, a functional block diagram of a preferred embodiment environmental test chamber cascade refrigeration system of the present invention is shown. For the purposes of this discussion, additional items comprising valves and expansion valves are shown in this figure. Additional components known to those skilled in the art are not shown, but it should be appreciated that they are not eliminated from the scope of the present invention however.

The system 300 comprises low and high stage systems, or loops, as discussed in reference to FIG. 4. The low stage loop uses refrigerant R508B. The low stage loop further comprises a low stage compressor 320. The discharge of the low stage compressor 320 is coupled to a cascade condenser 334 coupled within the cascade condenser 330. The cascade condenser 334 further comprises an evaporator 332 coupled to the high stage loop. The discharge of the low stage loop from the cascade condenser 334 is next coupled to the thermal storage unit 360 via two separate refrigerant paths.

The first path is coupled via bypass solenoid valve 338, coupled to expansion valve 322, and coupled to evaporator 362 within thermal storage unit 360. The evaporator 362 discharge returns to the low stage compressor 320 to which it is coupled.

The second path is coupled via condenser subcooler 364, located within the thermal storage unit 360, coupled to cool solenoid valve 368, coupled to expansion valve 318, and coupled to evaporator 312. The evaporator 312 is located within and coupled to the cooling load 310. The output of evaporator 312 returns to the low stage compressor 320 suction to which it is coupled.

The high stage loop uses refrigerant R507. The high stage loop further comprises a high stage compressor 340. The discharge of the high stage compressor 340 is coupled to a condenser 350 which serves as the main heat removal avenue from the system 300. The discharge of the high stage loop from the condenser 350 is next coupled to the cascade condenser 330 via two separate refrigerant paths.

The first path is coupled via bypass solenoid valve 352, then coupled to expansion valve 336, next coupled to evaporator 332. The evaporator 332 is located within and coupled to the cascade condenser 330. The evaporator 332 discharge returns to the high stage compressor 340 to which it is coupled.

The second path is coupled via the full cool solenoid 354, to the subcooler 366 located and coupled within the thermal storage unit 360. The subcooler 366 discharge is next coupled via expansion valve 336 to the evaporator 332. The evaporator 332 is located within and coupled to the cascade condenser 330. The evaporator 332 discharge returns to the high stage compressor 340 to which it is coupled.

The thermal storage unit 360, in a preferred embodiment, comprises DYNALENE™ Type-HC 50 (not shown herein) as the heat storage medium. This heat transfer fluid is available from Loikits Industrial Services of Whitehall Pa. DYNALENE™ Type-HC 50 has a freezing point of −76° F. The thermal storage unit 360 operating range can vary from approximately −125° F. to 0° F. The freezing and thawing of the DYNALENE within the range −125° F. to 0° F. stores thermal energy as a latent heat, which is in addition to the sensible heat storage. The thermal storage unit, in a preferred embodiment is also comprised of a copper tank, further comprising copper tubes and radiator fins to aid in the transfer of heat. An alternative embodiment of the thermal storage unit 360 utilizes a heat transfer fluid comprised of a silicon oil. However, as those skilled in the art will appreciate, many other means of thermal storage may also be utilized in the present invention. For example, without being limited to them, many other materials that could be used for thermal storage in the present invention include blocks of aluminum, a third refrigerant, glycol, etc.

Operation

The operation of the system 300 is as follows:

The initial conditions of the system 300 in preparation for full cooling are:

Both low and high stage compressors 320 and 340 are operating. It should be noted that while not shown herein, other required equipment such as fans, control equipment etc. is also functioning.

The cooling load 310 is warmer than the desired temperature. Note that a single section environmental test chamber is the cooling load 310 herein, although a dual section environmental test chamber could also be utilized herein.

The thermal storage unit 360 has already been pre-cooled down to approximately −100° F.

The low-stage system contains refrigerant R508B.

The high-stage system contains refrigerant R507.

The cooling load 310 is warmer than the desired temperature.

A Proportional-Integral-Derivative programmable temperature controller ("PID 316" hereinafter) is coupled to and controls the valves 338, 368, 354, and 352.

Full Cooling Operation (Note that the solenoid valves positioning is delineated on Table 1, FIG. 7 as an aid in the following discussion.)

Following the placement of an item under test into the environmental test chamber, cooled by the cooling load 310, the thermal transient is imposed as follows:

Full cooling begins when the PID 316 opens cool solenoid valve 368 and full cool solenoid valve 354; and simultaneously closes bypass solenoid valve 338 and bypass solenoid valve 352. Refrigerant R508B flows out of the thermal storage unit 360, from the condenser-subcooler 366, through cool solenoid valve 368. The refrigerant R508B then passes through the expansion valve 318 and enters the evaporator 312 within the cooling load 310 to cool the item under test. The refrigerant R508B becomes vaporized and travels to the low stage compressor 320 to be compressed. The refrigerant R508B next enters the condenser 334, within the cascade condenser 330, where the refrigerant R508B is condensed back into a liquid form. Note that at a high heat load situation the refrigerant R508B would be at a less than a 100% liquid state and the final phase change to 100% liquid would take place in the condenser-subcooler 364 of the thermal storage unit 360.

The refrigerant R508B then travels through the condenser-subcooler 364 inside the thermal storage unit 360 where the refrigerant R508B is cooled, thus reducing the enthalpy. The R508B then flows back to the cool solenoid valve 368 which completes the full cooling cycle for the low stage loop.

Simultaneously, with the low stage loop operation, the high stage loop functions as follows: The refrigerant R507 travels through full cool solenoid valve 354 into the subcooler 366, within the thermal storage unit 360. The refrigerant R507 then passes through the expansion valve 336 and enters the evaporator 332 within the cascade condenser 330 and absorbs the heat carried by the refrigerant R508B in the low stage loop. The refrigerant R507 becomes vaporized due to the increased heat content. The gaseous refrigerant R507 is next returned to the high stage compressor 340 where it is compressed. The compressed refrigerant R507 next enters the condenser 350 where it is condensed back into a liquid state. The refrigerant R507 is now back at the full cool solenoid valve 354 which completes the full cooling cycle for the high stage loop.

Reduced Cooling Operation

The temperature sensing probe 314 sends the cooling load 310 temperature to the PID 316. When the temperature has reached a desired set point, the PID 316 acts to reduce the cooling. The PID 316 proportions the cool solenoid valve 368 on a time cycle to maintain the desired temperature at the evaporator 312 within the cooling load 310. As the PID 316 is throttling the cool solenoid valve 368, the bypass solenoid valve 338 and bypass solenoid valve 352 open, and full cool solenoid valve 354 closes. This valve arrangement now provides only the required cooling to the cooling load 310, while diverting the balance of the cooling capacity to begin the recharging of the thermal storage unit 360. This recharge function also provides an alternative load for the low stage compressor 320 in lieu of a conventional hot gas bypass. (Hot gas bypass in conventional systems is used to give a refrigeration system a minimum load to operate, during periods when cooling demand is between 0 and 100% of the full capacity.) This is a further feature of the present invention in contrast to prior art environmental chamber cooling systems that will typically turn off the refrigeration system when the cooling demand has been at 0% for a period of time.

During the reduced cooling and recharge period, the liquid refrigerant R508B still passes through the condenser-subcooler 364. This occurs because the cool solenoid valve 368 is still held open by the PID 316. However, the refrigerant R508B now also passes through bypass solenoid valve 338 into the evaporator 362 of the thermal storage unit 360 thus beginning the removal of the stored heat within the thermal storage unit 360. The liquid refrigerant R507 now only passes through bypass solenoid valve 352, as full cool solenoid vale 354 is closed, and then directly back to the cascade condenser 330 which removes heat load from the thermal storage unit 360 thus aiding in the recharge of the thermal storage unit 360.

This operation continues until the testing requirements have been met for the item under test within the cooling load 310, and the thermal storage unit is fully recharged (if desired).

Alternate Embodiment

Figure 6:
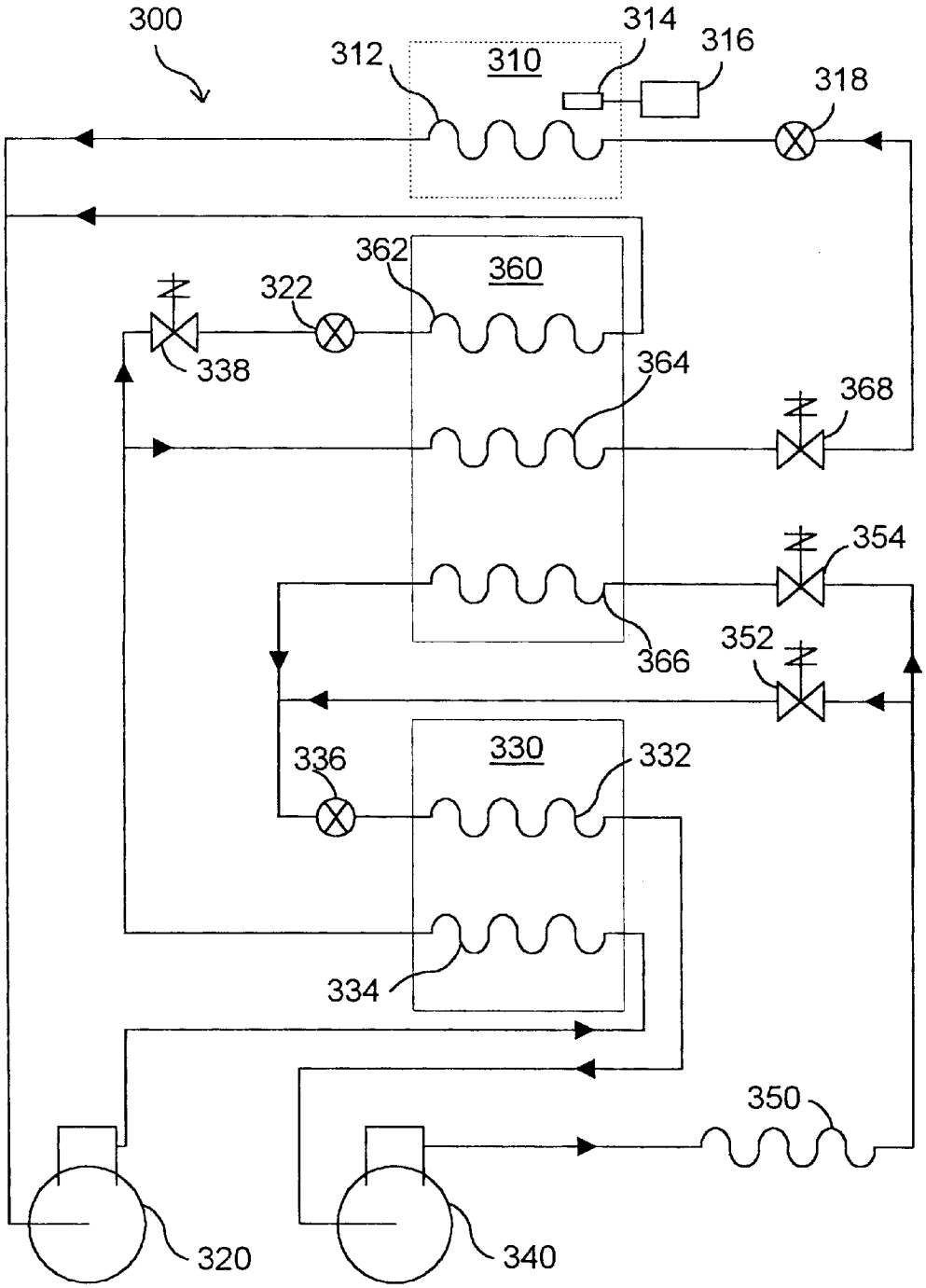
FIG. 6 is a functional block diagram of an alternative embodiment environmental test chamber cascade refrigeration system of the present invention.

Referring to FIG. 6, a functional block diagram of an alternate embodiment, environmental test chamber cascade refrigeration system, of the present invention is shown. For the purposes of this discussion, additional items comprising valves and expansion valves are shown in this figure. Additional components known to those skilled in the art are not shown, but it should be appreciated that they are not eliminated from the scope of the present invention however.

The system 400 comprises low and high stage systems, or loops, as discussed in reference to FIG. 4. The low stage loop uses refrigerant R508B. The low stage loop further comprises a low stage compressor 420. The discharge of the low stage compressor 420 is coupled to a cascade condenser 434 coupled within the cascade condenser 430. The cascade condenser 434 further comprises an evaporator 432 coupled to the high stage loop. The discharge of the low stage loop from the cascade condenser 434 is next coupled to the thermal storage unit 460 via two separate refrigerant paths.

The first path is coupled via bypass solenoid valve 438, coupled to expansion valve 422, and coupled to evaporator 462 within thermal storage unit 460. The evaporator 462 discharge returns to the low stage compressor 420 to which it is coupled.

The second path is coupled via cool solenoid valve 468, coupled to expansion valve 418, and coupled to evaporator 412. The evaporator 412 is located within and coupled to the cooling load 410. The output of evaporator 412 returns to the low stage compressor 420 suction to which it is coupled.

The high stage loop uses refrigerant R507. The high stage loop further comprises a high stage compressor 440. The discharge of the high stage compressor 420 is coupled to a condenser 450 that serves as the main heat removal avenue from the system 400. The discharge of the high stage loop from the condenser 450 is next coupled to the cascade condenser 430 via two separate refrigerant paths.

The first path is coupled via bypass solenoid valve 452, then coupled to expansion valve 436, next coupled to evaporator 432. The evaporator 432 is located within and coupled to the cascade condenser 430. The evaporator 432 discharge returns to the high stage compressor 440 to which it is coupled.

The second path is coupled via the full cool solenoid 454, to the subcooler 466 located and coupled within the thermal storage unit 460. The subcooler 466 discharge is next coupled via expansion valve 436 to the evaporator 432. The evaporator 432 is located within and coupled to the cascade condenser 430. The evaporator 432 discharge returns to the high stage compressor 440 to which it is coupled.

The thermal storage unit 460, in a alternate embodiment, comprises a silicon oil (not shown herein) that has a freezing point of −76° F. The thermal storage unit 460 operating range can vary from approximately −125° F. to 0° F. The freezing and thawing of the silicon oil within the range −125° F. to 0° F. stores thermal energy as a latent heat, which is in addition to the sensible heat storage. The thermal storage unit, in a preferred embodiment is also comprised of a copper tank, further comprising copper tubes and radiator fins to aid in the transfer of heat.

As those skilled in the art will appreciate, many other means of thermal storage may utilized in the present invention. For example, without being limited to them many other materials could be used for thermal storage including blocks of aluminum, a third refrigerant, glycol, etc.

Operation

The operation of the system 400 is as follows.

The initial conditions of the system 400 in preparation for full cooling are:

- Both low and high stage compressors 420 and 440 are operating. It should be noted that while not shown herein, other required equipment such as fans, control equipment etc. is also functioning.
- The cooling load 410 is warmer than the desired temperature. Note that a single section environmental test chamber is the cooling load 410 herein, although a dual section environmental test chamber might also be utilized with similar benefits realized as for a single section environmental test chamber.
- The thermal storage unit 460 has already been pre-cooled down to approximately −100° F.
- The low-stage system contains refrigerant R508B.
- The high-stage system contains refrigerant R507.
- The cooling load 410 is warmer than the desired temperature.
- A Proportional-Integral-Derivative programmable temperature controller ("PID 416" hereinafter) is coupled to and controls the valves 438, 468, 454, and 452.

Full Cooling Operation

Following the placement of an item under test into the environmental test chamber, cooled by the cooling load 410, the thermal transient is imposed as follows:

Full cooling begins when the PID 416 opens cool solenoid valve 468 and full cool solenoid valve 454; and simultaneously closes bypass solenoid valve 438 and bypass solenoid valve 452. Refrigerant R508B flows through cool solenoid valve 468. The refrigerant R508B then passes through the expansion valve 418 and enters the evaporator 412 within the cooling load 410 to cool the item under test. The refrigerant R508B becomes vaporized and travels to the low stage compressor 420 to be compressed. The refrigerant R508B next enters the condenser 434, within the cascade condenser 430, where the refrigerant R508B is condensed back into a liquid form. The refrigerant R508B then travels back to the cool solenoid valve 468. This completes the full cooling cycle for the low stage loop.

Simultaneously, with the low stage loop operation, the high stage loop functions as follows: The refrigerant R507 travels through full cool solenoid valve 454 into the sub-cooler 466, within the thermal storage unit 460. The refrigerant R507 then passes through the expansion valve 436 and enters the evaporator 432 within the cascade condenser 430 and absorbs the heat carried by the refrigerant R508B in the low stage loop. The refrigerant R507 becomes vaporized due to the increased heat content. The gaseous refrigerant R507 is next returned to the high stage compressor 440 where it is compressed. The compressed refrigerant R507 next enters the condenser 450 where it is condensed back into a liquid state. The refrigerant R507 is now back at the full cool solenoid valve 454 which completes the full cooling cycle for the high stage loop.

Reduced Cooling Operation

The temperature sensing probe 414 sends the cooling load 410 temperature to the PID 416. When the temperature has reached a desired set point, the PID 416 acts to reduce the cooling. The PID 416 proportions the cool solenoid valve 468 on a time cycle to maintain the desired temperature at the evaporator 412 within the cooling load 410. As the PID 416 is throttling the cool solenoid valve 468, the bypass solenoid valve 438 and bypass solenoid valve 452 open, and full cool solenoid valve 454 closes. This valve arrangement now provides only the required cooling to the cooling load 410, while diverting the balance of the cooling capacity to begin the recharging of the thermal storage unit 460. This recharge function also provides an alternative load for the low stage compressor 420 in lieu of a conventional hot gas bypass. (Hot gas bypass in conventional systems is used to give a refrigeration system a minimum load to operate, during periods when cooling demand is between 0 and 100% of the full capacity.) This is a further feature of the present invention in contrast to prior art environmental chamber cooling systems that will typically turn off the refrigeration system when the cooling demand has been at 0% for a period of time.

During the reduced cooling and recharge period, the liquid refrigerant R508B still passes through cool solenoid valve 468 that is still held open by the PID 416, but the refrigerant R508B now also passes through bypass solenoid valve 438 into the evaporator 462 of the thermal storage unit 460 thus beginning the heat removal of the stored heat within the thermal storage unit 460. The liquid refrigerant R507 now only passes through bypass solenoid valve 452, as full cool solenoid vale 454 is closed, and then directly back to the cascade condenser 430 which removes heat load from the thermal storage unit 460 thus aiding in the recharge of the thermal storage unit 460.

This operation continues until the testing requirements have been met for the item under test within the cooling load 410, and the thermal storage unit is fully recharged (if desired).

While the invention has been particularly shown and described with reference to the preferred embodiments thereof, it will be understood by those skilled in the art that the foregoing and other changes in form, and details may be made therein without departing from the spirit and scope of the invention.

What is claimed is:

1. An environmental test chamber fast cool down system, comprising, in combination:

an environmental test chamber evaporator;

a cascade condenser coupled to said environmental test chamber evaporator;

a sub-cooled primary stage loop coupled to said cascade condenser;

a sub-cooled secondary stage loop coupled to said cascade condenser; and a thermal storage unit coupled to said sub-cooled primary stage loop and to said sub-cooled secondary stage loop.

2. The system of claim 1 wherein said sub-cooled primary stage loop comprises refrigerant from the classes of refrigerants having properties substantially similar to R507, R404, and R134A.

3. The system of claim 1 wherein said sub-cooled secondary stage loop comprises refrigerant from the classes of refrigerants having properties substantially similar to R508B, and R23.

4. The system of claim 1 wherein said thermal storage unit comprises:

a condenser coil; and an evaporator coil.

5. The system of claim 4 wherein said thermal storage unit further comprises a condenser-subcooler coil.

6. The system of claim 4 wherein said thermal storage unit comprises a heat storage medium of silicon oil.

7. The system of claim 4 wherein said thermal storage unit comprises a heat storage medium of glycol.

8. The system of claim 4 wherein said thermal storage unit comprises a heat storage medium of substantially solid aluminum.

9. The system of claim 2 wherein said sub-cooled secondary stage loop comprises refrigerant from the classes of refrigerants having properties substantially similar to R508B, and R23.

10. The system of claim 9 wherein said thermal storage unit comprises:

a condenser coil; and an evaporator coil.

11. The system of claim 10 wherein said thermal storage unit further comprises a condenser-subcooler coil.

12. An environmental test chamber cooling system, comprising, in combination:

an environmental test chamber evaporator;

a thermal storage unit coupled to said environmental test chamber evaporator having an operational temperature down to about −125° F.;

a high stage refrigeration loop coupled to said thermal storage unit wherein said high stage refrigeration loop has up to an enthalpy change of about 104 BTUs per pound of refrigerant circulated; and a low stage refrigeration loop coupled to said thermal storage unit wherein said low stage refrigeration loop has up to an enthalpy change of about 68 BTUs per pound of refrigerant circulated.

13. The system of claim 12 wherein said thermal storage unit comprises:

a condenser coil; and an evaporator coil.

14. The system of claim 13 wherein said thermal storage unit further comprises a condenser-subcooler coil.

15. A method of fast cooling an environmental test chamber, comprising the steps of:

pre-cooling a thermal storage unit to about minus 125° F.;

cooling a first refrigerant to an enthalpy of about 50.6;

circulating said first refrigerant through said thermal storage unit to an enthalpy of about −17.2;

circulating said first refrigerant through a cascade condenser; and circulating a second refrigerant through said cascade condenser to an enthalpy of about 14.6.

16. The method of claim 15 further comprising the steps of:

circulating said second refrigerant through said thermal storage unit to an enthalpy of about −16.4; and circulating said second refrigerant through an environmental test chamber evaporator cooling coil.

17. The method of claim 16 further comprising the step of reducing the flow of said second refrigerant through said environmental test chamber evaporator cooling coil when said environmental test chamber evaporator cooling coil reaches a desired temperature.

18. The method of claim 17 further comprising the step of stopping the flow of said first refrigerant through said thermal storage unit when said environmental test chamber evaporator cooling coil reaches a desired temperature.

19. The method of claim 18 further comprising the step of circulating the balance of said second refrigerant no longer circulated through said environmental test chamber evaporator cooling coil, through a thermal recharge coil within said thermal storage unit to recharge said thermal storage unit to about minus 125° F.

20. The method of claim 15 further comprising the step of circulating said second refrigerant through an environmental test chamber evaporator cooling coil.

21. The method of claim 20 further comprising the step of reducing the flow of said second refrigerant through said environmental test chamber evaporator cooling coil when said environmental test chamber evaporator cooling coil reaches a desired temperature.

22. The method of claim 21 further comprising the step of stopping the flow of said first refrigerant through said thermal storage unit when said environmental test chamber evaporator cooling coil reaches a desired temperature.

23. The method of claim 22 further comprising the step of circulating the balance of said second refrigerant no longer circulated through said environmental test chamber evaporator cooling coil, through a thermal recharge evaporator coil within said thermal storage unit to recharge said thermal storage unit to about minus 125° F.

* * * * *